US005632634A

United States Patent [19]

Soes

[11] Patent Number: 5,632,634

[45] Date of Patent: May 27, 1997

[54] HIGH FREQUENCY CABLE CONNECTOR

[75] Inventor: Lucas Soes, Rosmalen, Netherlands

[73] Assignee: The Whitaker Corporation, Wilmington, Del.

[21] Appl. No.: 412,837

[22] Filed: Mar. 29, 1995

Related U.S. Application Data

[63] Continuation of Ser. No. 103,468, Aug. 6, 1993, abandoned.

[30] Foreign Application Priority Data

| | | | |
|---|---|---|---|
| Aug. 18, 1992 | [GB] | United Kingdom | 9217546 |
| Mar. 26, 1993 | [GB] | United Kingdom | 9306399 |

[51] Int. Cl.[6] ..... H01R 4/66

[52] U.S. Cl. ..... 439/101; 439/609

[58] Field of Search ..... 439/607–610, 439/92, 108, 101

[56] References Cited

U.S. PATENT DOCUMENTS

| | | | |
|---|---|---|---|
| 4,398,783 | 8/1983 | Kelly | 339/177 |
| 4,494,816 | 1/1985 | Tamburro | 339/177 R |
| 4,605,276 | 8/1986 | Hasircoglu | 339/176 MF |
| 4,611,867 | 9/1986 | Ichimura et al. | 339/14 R |
| 4,889,959 | 12/1989 | Taylor et al. | 439/95 X |
| 4,966,557 | 10/1990 | Barkus et al. | 439/246 |
| 4,984,992 | 1/1991 | Beamenderfr et al. | 439/108 |
| 5,057,038 | 10/1991 | Bowen et al. | 439/608 X |
| 5,080,597 | 1/1992 | Seidel et al. | 439/95 X |
| 5,114,364 | 5/1992 | Hunter | 439/497 |
| 5,197,893 | 3/1993 | Morlion et al. | 439/101 |

FOREIGN PATENT DOCUMENTS

| | | |
|---|---|---|
| A-0-131-248 | 1/1985 | European Pat. Off. . |
| A-0-446-980 | 9/1991 | European Pat. Off. . |
| A-5-041-260 | 2/1993 | Japan . |

*Primary Examiner*—David L. Pirlot

[57] ABSTRACT

An electrical connector is shown which is useable with coaxial or twinaxial shielded cables where an inner housing module has a pair of electrical terminals positioned therein for electrical connection with a signal conductor of the coaxial or twinaxial cable. The housing is insertable within a shield member to form a shielded subassembly. A grounding spring clip is positioned intermediate the two shielded sub assemblies, thereby commoning the adjacent shields, and at the same time provides contact portions for receiving pins of a mating pin field.

52 Claims, 19 Drawing Sheets

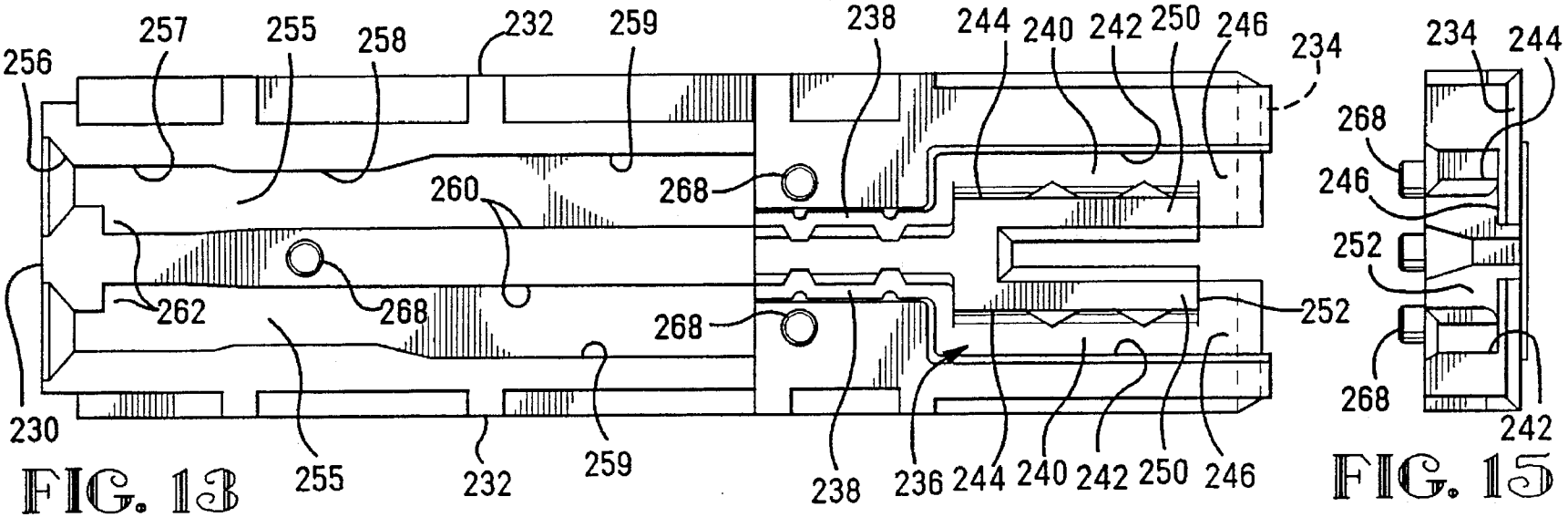
FIG. 15
FIG. 13
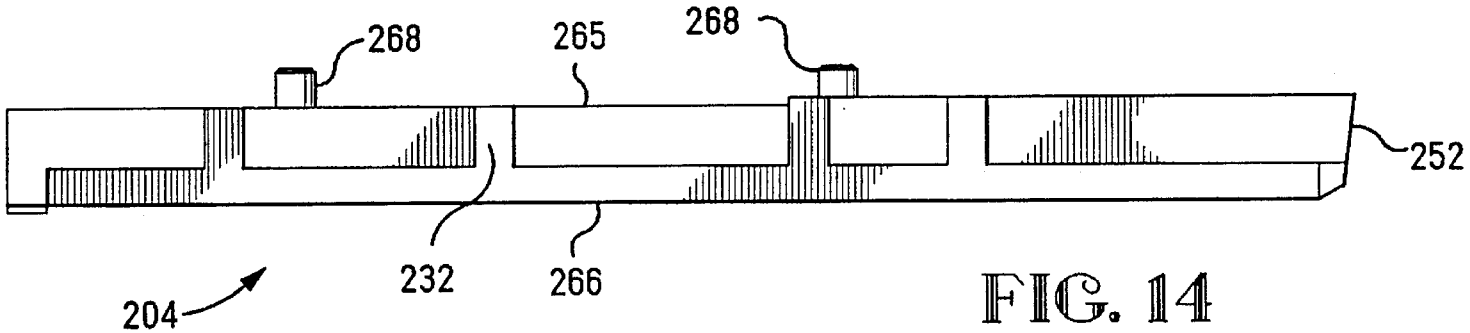
FIG. 14

HIGH FREQUENCY CABLE CONNECTOR

This application is a Continuation of Application Ser. No. 08/103,468, filed Aug. 6, 1993, now abandoned.

FIELD OF THE INVENTION

The invention is directed to a high frequency electrical connector for a twin axial or a coaxial cable.

DESCRIPTION OF THE PRIOR ART

In the application of high frequency electrical connectors, it is important to entirely shield the signal contacts. However this often results in a complicated design or otherwise large connector system resulting in a large quantity of overall space required.

One shielded coaxial connector system is shown in European Patent Application 0 446 980 where a shielded coaxial contact surrounds a dielectric body where the shield is electrically grounded to a shield of an electrical cable. The outer shield includes contact members formed integrally therewith for making contact with a mating pin or with an adjacent shield of an adjacent contact.

One of the difficulties that arises with this type of design is that the customer is responsible for terminating the electrical conductor of the shielded cable as well as the braid of the shielded cable to the connector terminals and subsequently installing the terminals in an associated housing. Assembly equipment varies from customer to customer and it is difficult to monitor the quality of the connections being made as well as the handling of the terminals during the installation process such that it is common to have damaged shield contacts on the outer periphery of this shield member which may prevent mating of the electrical pins in the mating connector, or otherwise prevent an electrical connection being made between the ground pin and the connector shield.

SUMMARY OF THE INVENTION

It is an object of the invention to provide a high density electrical connector for use with coaxial or twinaxial cable connectors, where the connector has an outer shield which can be electrically connected to a ground pin field in a mating connector.

It is a further object of the invention to provide an easy connector assembly process, while at the same time, provide an assembly where the ground contacts of the shield member or not damaged.

The objects of the invention were accomplished by providing a high density shielded electrical connector comprising at least two inner insulating housings separately surrounded by an outer shielding member, and having inner signal contacts, the outer shielding members being common together by way of a grounding spring clip which also defines a mating contact in the same direction as that of said signal contacts.

BRIEF DESCRIPTION OF THE DRAWINGS

FIG. 13 shows an upper plan view of the inner housing part of the cable connector of FIG. 12;

FIG. 14 shows a side view of the housing part shown in FIG. 13;

FIG. 15 shows an end view of the housing part of either of FIGS. 13 or 14;

DETAILED DESCRIPTION OF THE PREFERRED EMBODIMENT

Figure 2:
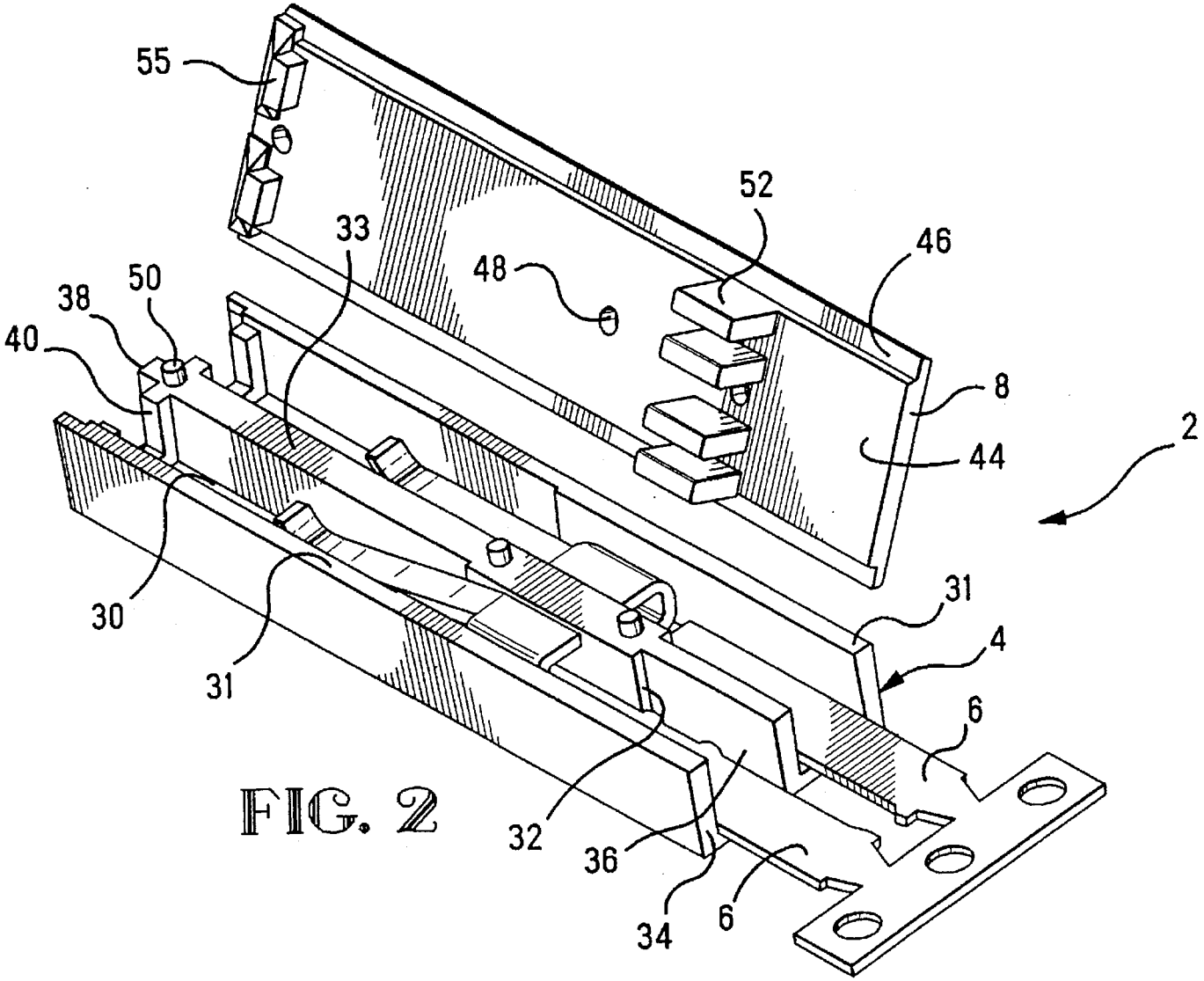
FIG. 2 is an isometric view showing the terminals of FIG. 1 positioned within a lower housing portion with an upper housing portion poised for receipt over the lower housing portion.

With reference first to FIG. 2, a connector subassembly is shown generally at 2 comprised of an insulating housing portion 4, a pair of electrical terminals 6 and a cover portion 8.

Figure 1:
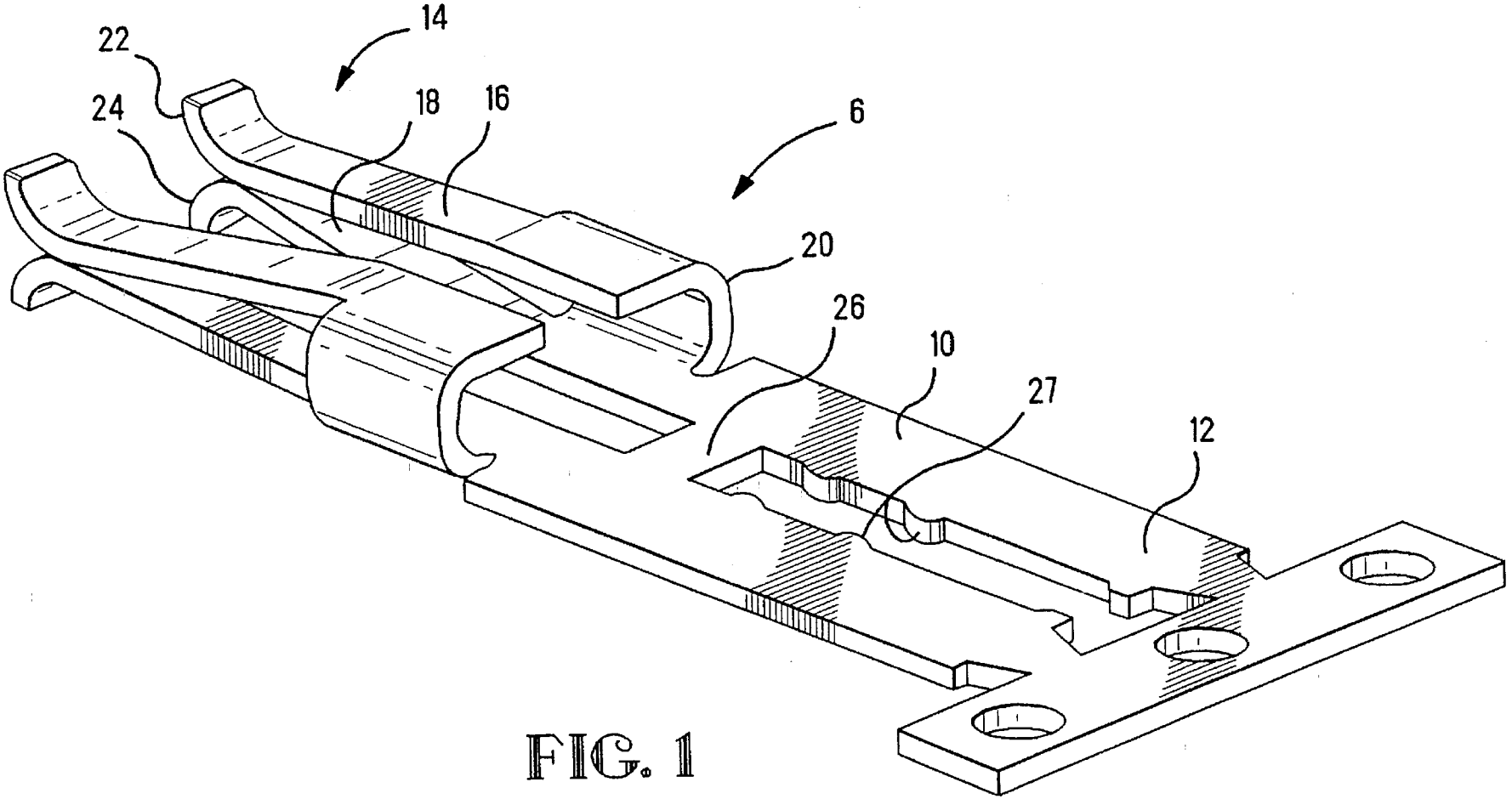
FIG. 1 is an isometric view showing two stamped and formed electrical terminals for use in the connector assembly.

With respect now to FIG. 1, the terminal pairs are shown as a stamped and formed set of electrical terminals having base portions 10 forming rear wire receiving surfaces 12 and forward contact portions 14. The contact portions are formed by two contact arms 16 and 18 where the contact arm 18 extends forwardly from the base portion 10 while contact arm 16 is folded over about an integral tab portion 20 to place the contact arms one above the other. The contact arms are radiused at their front edges for example at 22, 24 to form lead-in sections for a mating tab in a mating connector. The terminal pair 6 include a strengthening bar 26 integrally formed between the two base portions 10 for rigidity purposes, but is stamped away prior to insertion in the housing.

With respect again to FIG. 2, the housing member 4 includes two side by side channel-like openings 30 for receiving the terminals 6 therein. The housings include a reduced thickness portion at 32 which receives the retaining barbs 27 located along the side edges of the base portions 10, thereby holding the terminals in position within the housing. It should be appreciated that the channel-like openings open through the rear face 34 of the connector housing through openings 36. The housing 4 further includes a front mating face 38 providing pin receiving openings at 40 for receiving the pins of a mating electrical connector (not shown herein).

Figure 3:
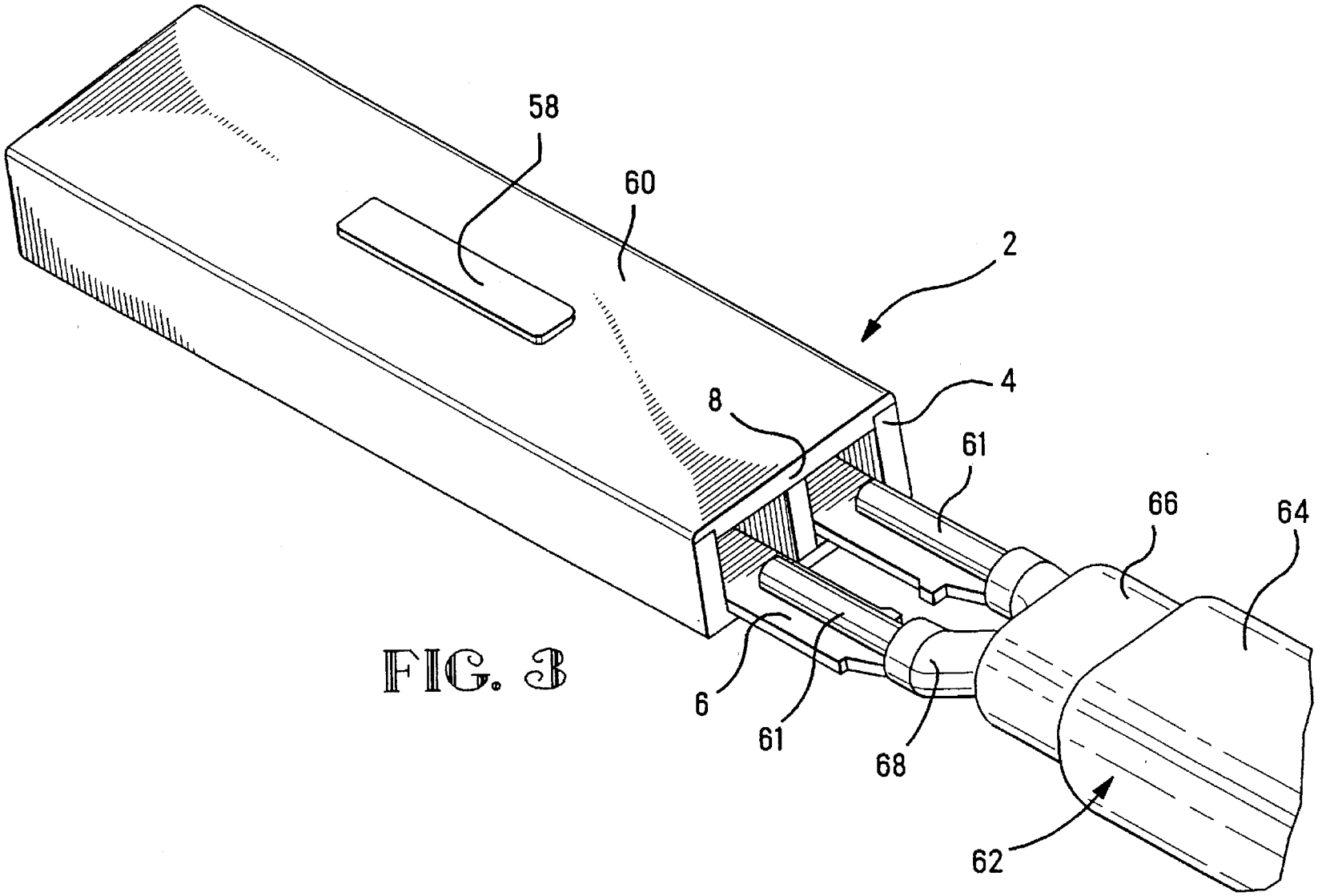
FIG. 3 is a view showing the cover portion in place with a twinaxial cable prepared for connection to the terminals of FIG. 1.
Figure 4:
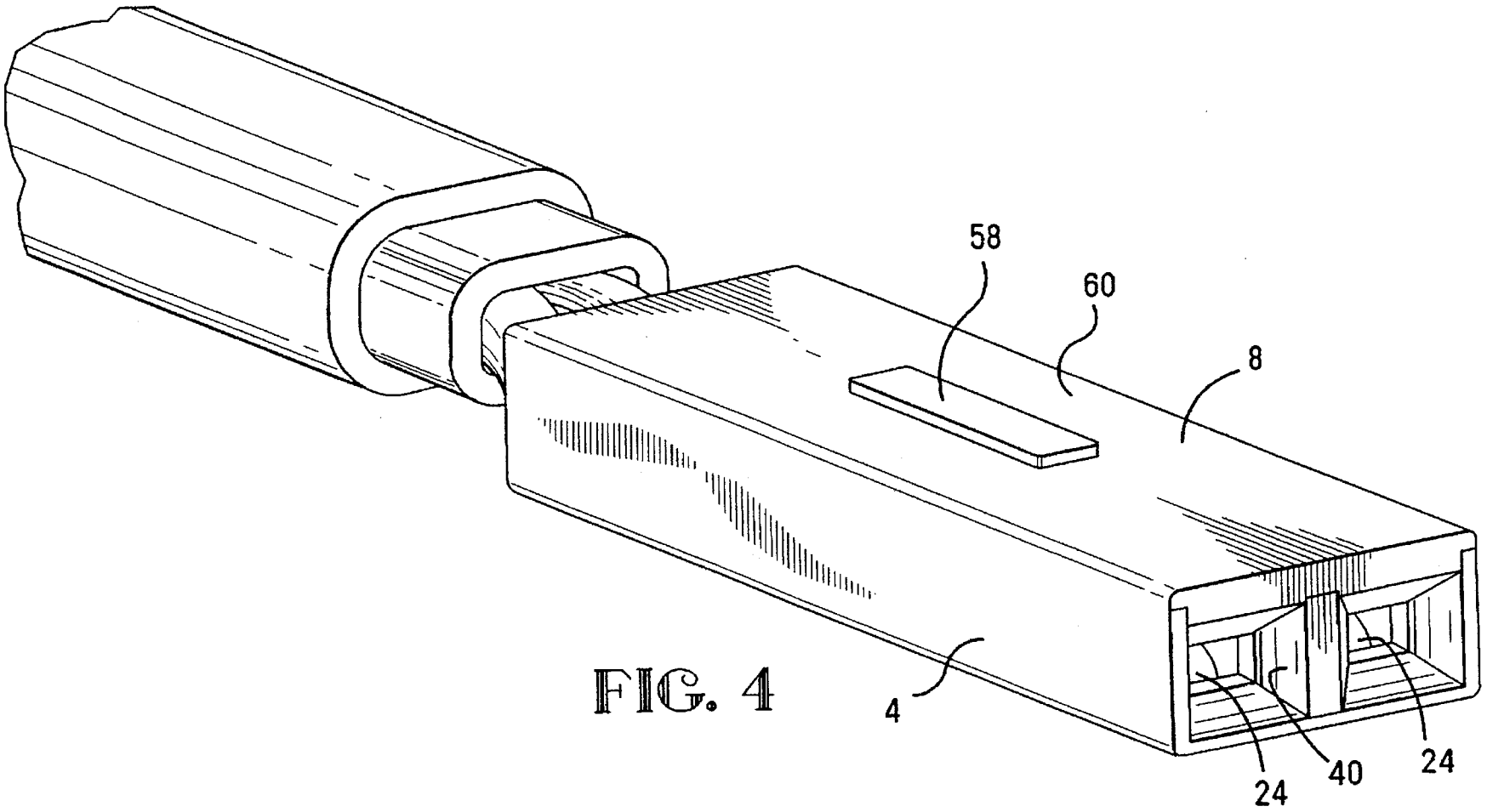
FIG. 4 is an isometric view from the opposite end of the housing as shown in FIG. 3.

With reference still to FIG. 2, the cover member includes an inner surface 44 having recessed edges 46 profiled for receipt on top edges of the side walls 31. Alignment of the cover member 8 with the housing member 4 is insured by cooperating apertures 48 in the cover part which cooperate with a plurality of studs 50 along the separating rib 33 of the housing portion. Furthermore, retention of the terminals 6 within the housing is insured by way of locking bars 52 which extend downwardly from the inner surface 44 of the cover member 8, and when the cover is in the fully closed position, are locked behind the contact arms 16. The forward end of the cover 8 includes wall portions 55 which cooperate with the openings 40 to form a closed pin-receiving opening. As shown in FIGS. 3 and 4, the cover member 8 is shown in the closed position with a raised section 58 extending above the upper surface 60 of the cover portion 8.

As shown best in FIG. 3, the connector 2 has the terminal platform portions 6 extending outwardly of the housing 4 profiled for receiving the conductors 61 of a twinax cable 62. The cable 62 includes an outer insulating jacket 64 which is stripped partially to expose the conductive shield 66, while the insulation 68 of the individual insulated conductors 61 is stripped to expose the conductors 61, such that they are positioned on top of the platforms 6, where they can be soldered or otherwise welded in place.

Figure 5:
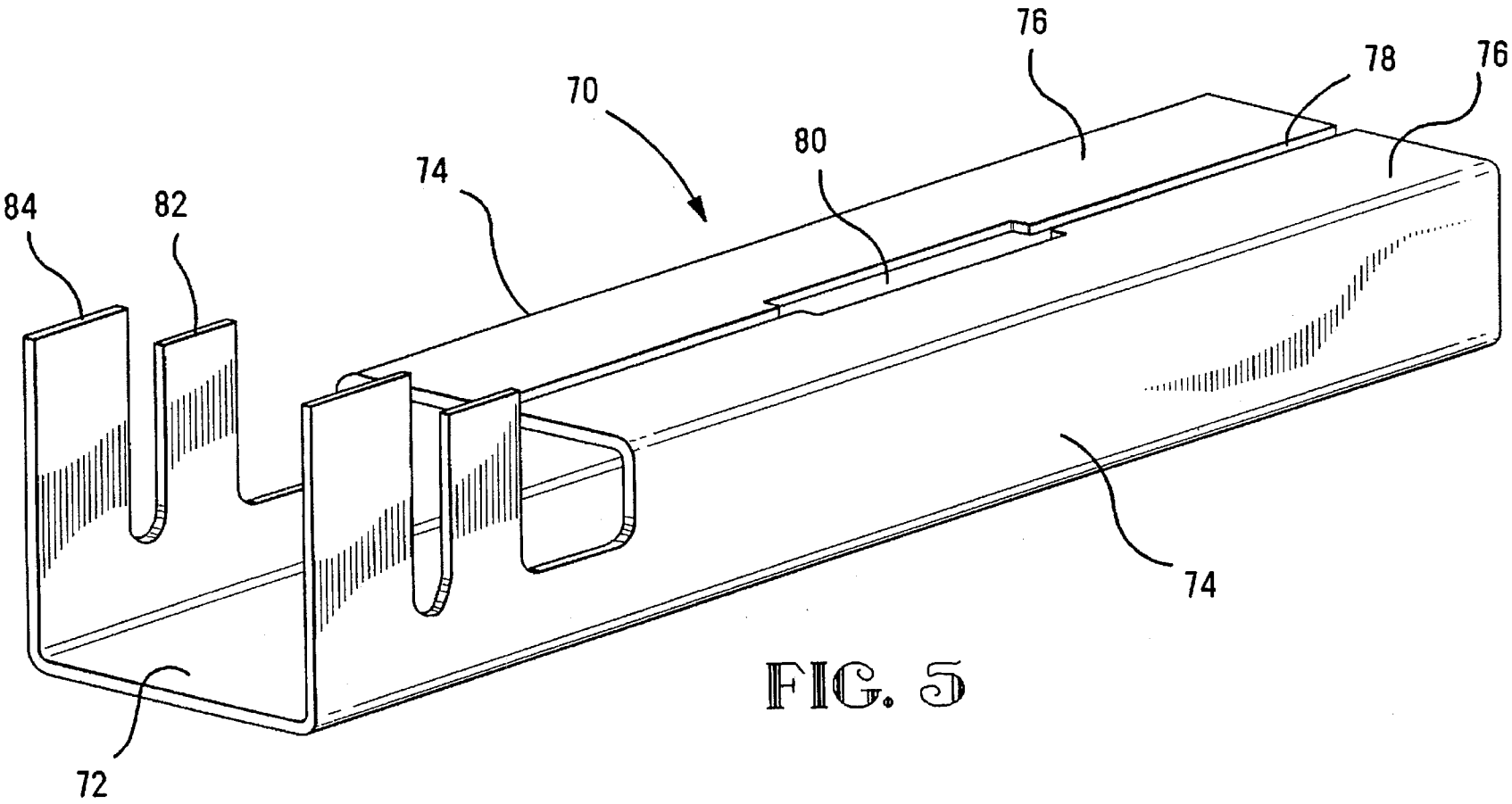
FIG. 5 is an isometric view of an outer shield portion which is receivable over the housing depicted in FIG. 4.
Figure 6:
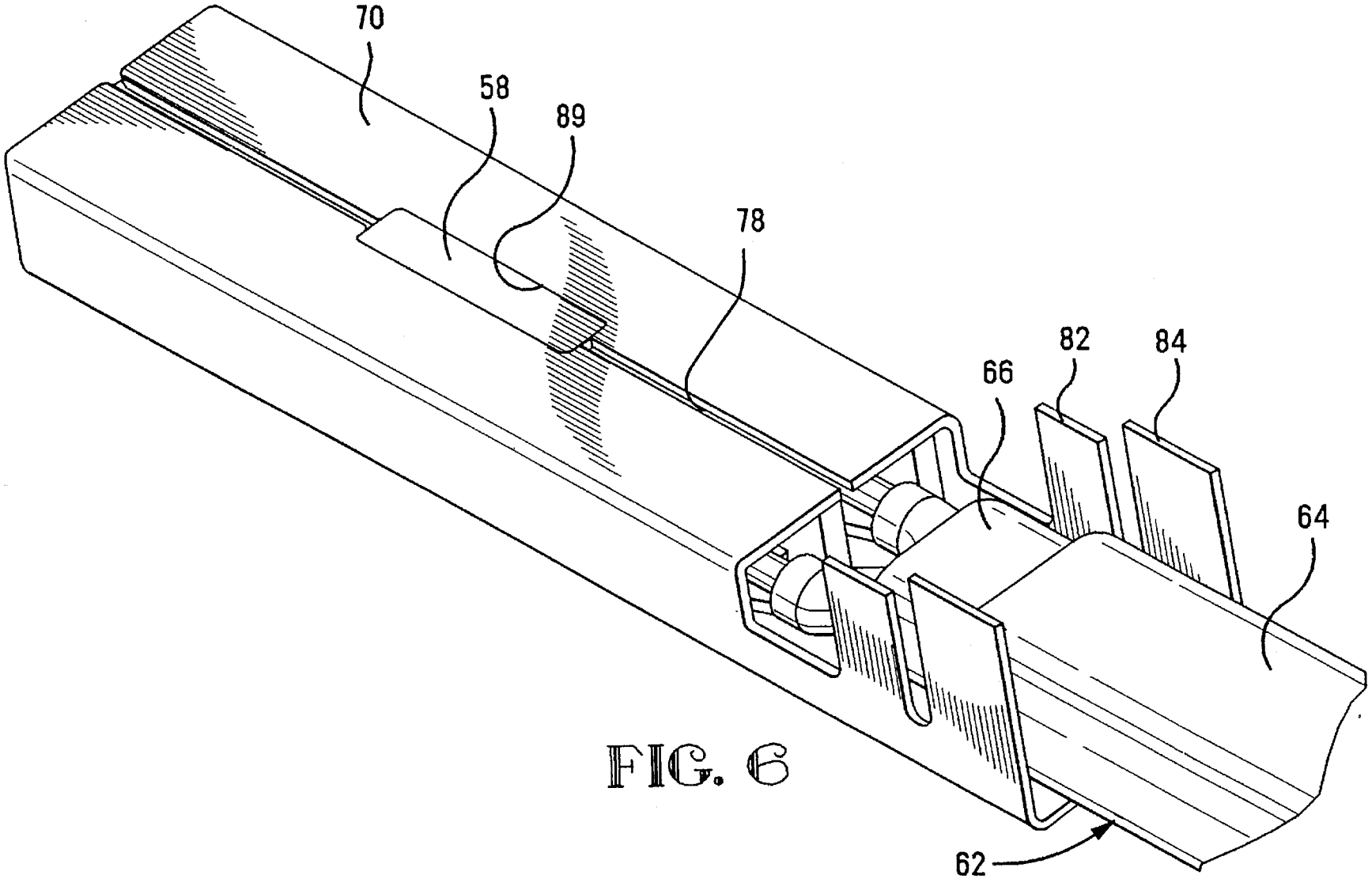
FIG. 6 shows the housing of FIG. 3 positioned within the outer shielding shell of FIG. 5.

With respect now to FIG. 5, an outer shield member is shown generally at 70, which is stamped and formed from a flat sheet of metal material, to include a base portion shown at 72 having folded up sidewalls 74 and folded over split cover parts 76 having an axial seam at 78. Intermediate the cover parts 76 and formed by way of the seam 78 is a rectangular opening at 80 which is profiled to receive the raised section 58 of the cover part 8. Extending integrally from the sidewalls 74 are crimp portions 82 profiled for crimping to the braid 66 of the twinax cable 62. Also extending integrally from the side walls 74 are strain relief crimp arms 84 profiled to crimp around the outer jack portion 64 of the twinax connector. With respect now to FIG. 6, the assembly shown in FIG. 4 is insertable through a rear entry portion of the shield member 70, to the position shown in FIG. 6. In the preferred embodiment of the invention the side walls 74 are overstamped such that upon insertion of the housing member 4, the seam 78 is slightly opened such that edges 89 of the opening 80 are in contact with the raised portion 58. As shown in FIG. 6, the shield arms 82 are shown in position to be crimped to the ground shield portion 66 of the cable 62 while the strain relief 84 are profiled to grip the outer jacket 64.

Figure 7:
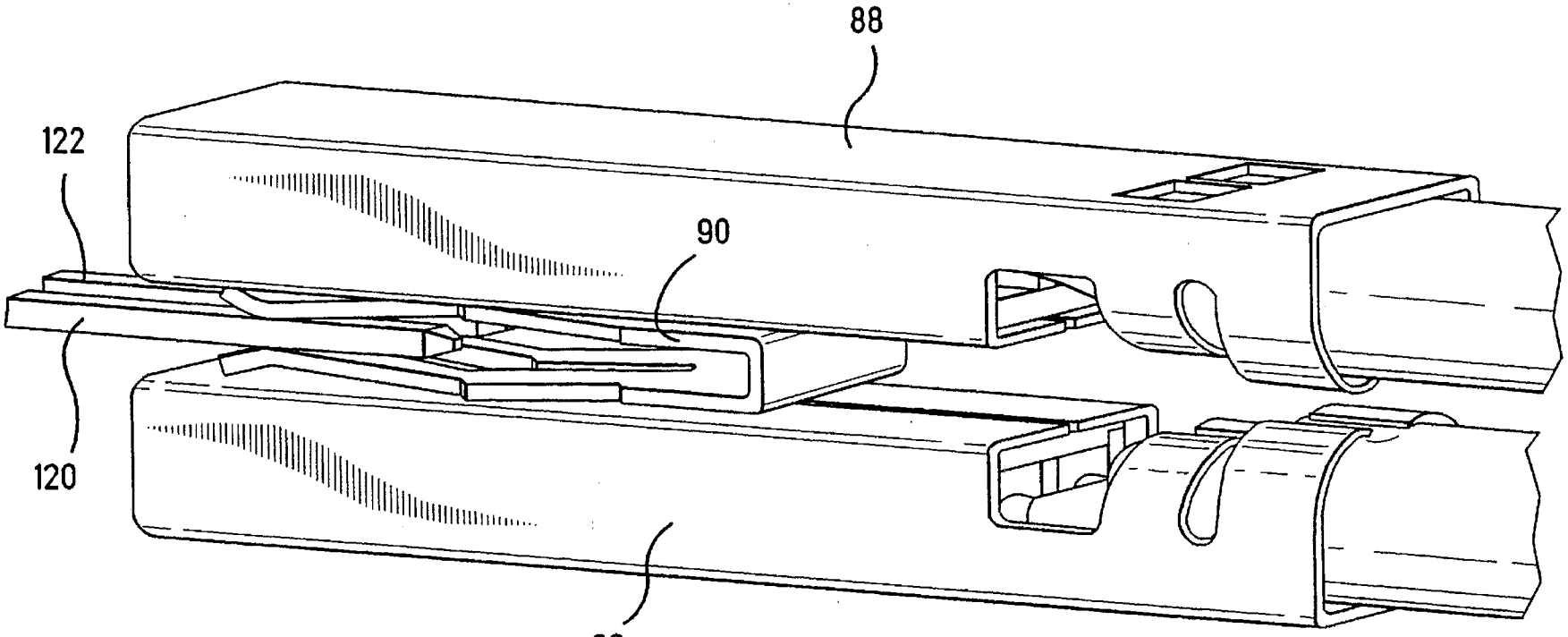
FIG. 7 is a perspective view showing a ground terminal placed medially between two adjacent outer shielding shells which commons the two shells.

With respect now to FIG. 7, two shielded housings are shown at 88 spaced apart from one another and disposed in a parallel manner. A grounding spring clip 90 is positioned intermediate the two shielded housings 88 whereby the outer shields of the two shielded connectors 88 are commoned together.

Figure 9:
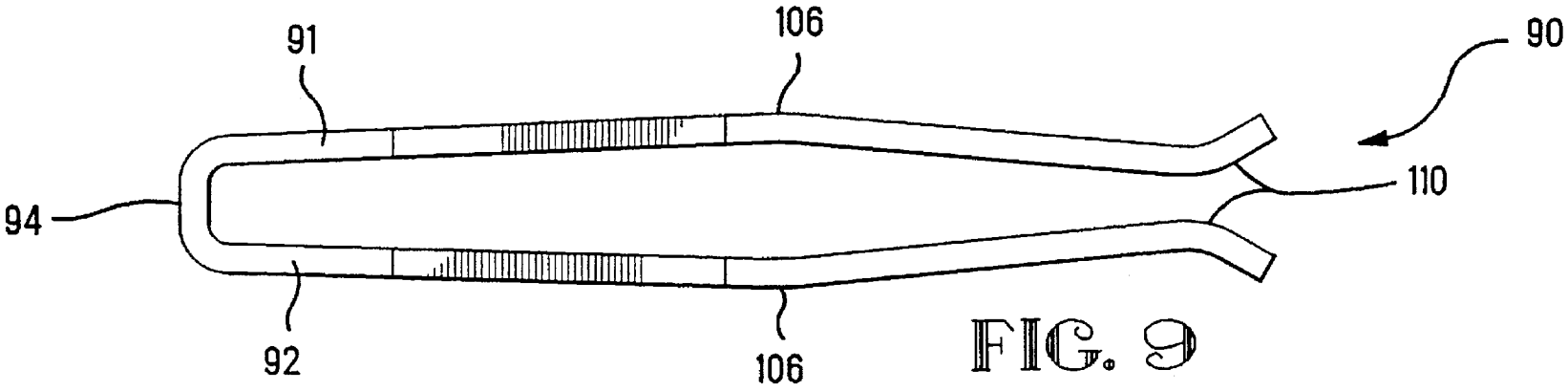
FIG. 9 shows a side view of the contact as shown FIG. 8.
Figure 8:
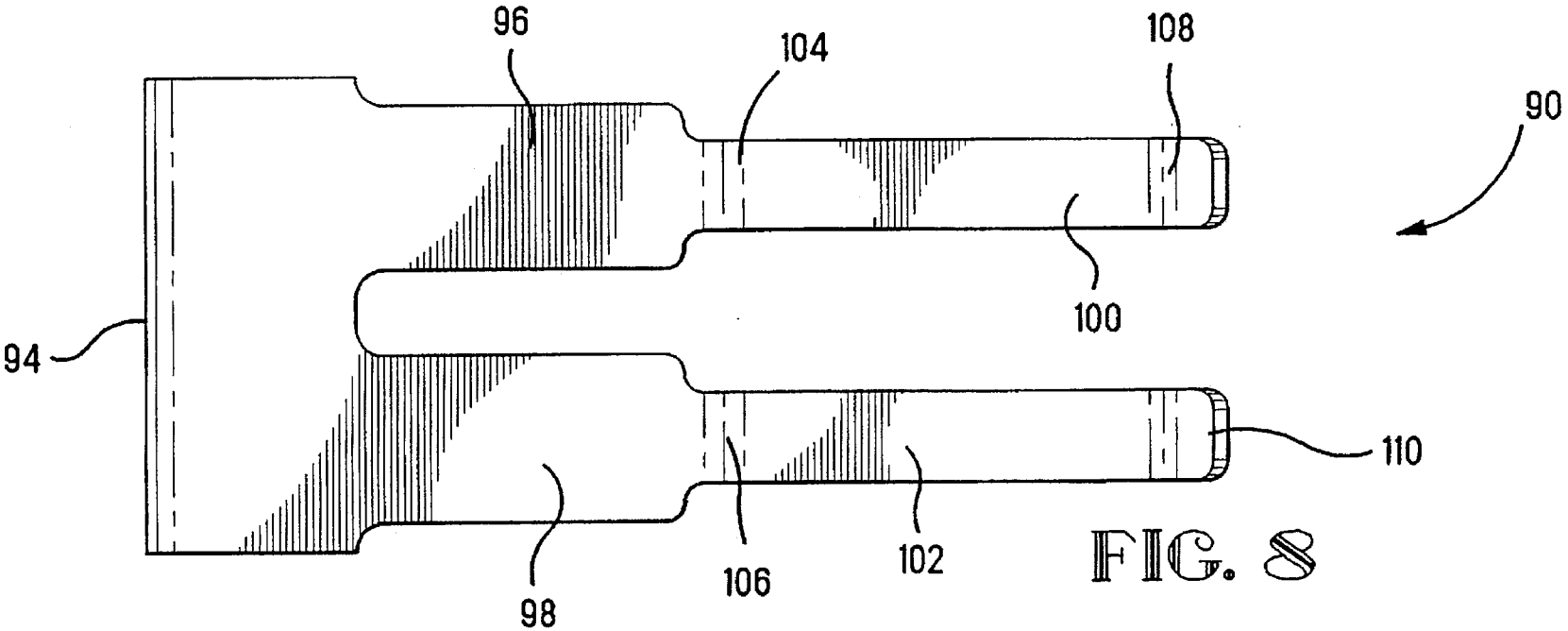
FIG. 8 is an upper plan view of the commoning contact shown in FIG. 7.

With respect to FIGS. 8 and 9, the grounding spring clip 90 is shown as a stamped and formed U-shaped member formed from upper and lower plate portions 91 and 92 (FIG. 9) stamped about a bight portion 94. The plate portions 91 and 92 are stamped into individual contact arms 96 and 98 having individual contact portions 100 and 102 extending forwardly therefrom. The contact portions 100 and 102 are spaced apart by a dimension of 2 mm such that the two contact portions can connect pins on a 2 mm grid pattern. As shown best in FIG. 9, the contact arm portions 96, 98 and 100, 102 are formed to project outwardly at 104, 106 to form contact portions to common the adjacent shield members, as shown in FIG. 7. The contact arms 100 and 102 are constricted at the front portion to form contact surfaces 108 and 110 for mating with a complementary pin field. This is shown best in FIG. 7 where pins 120 and 122 are shown in a spaced apart manner and are profiled to be received within the contacts formed at 108 and 110.

Figure 10:
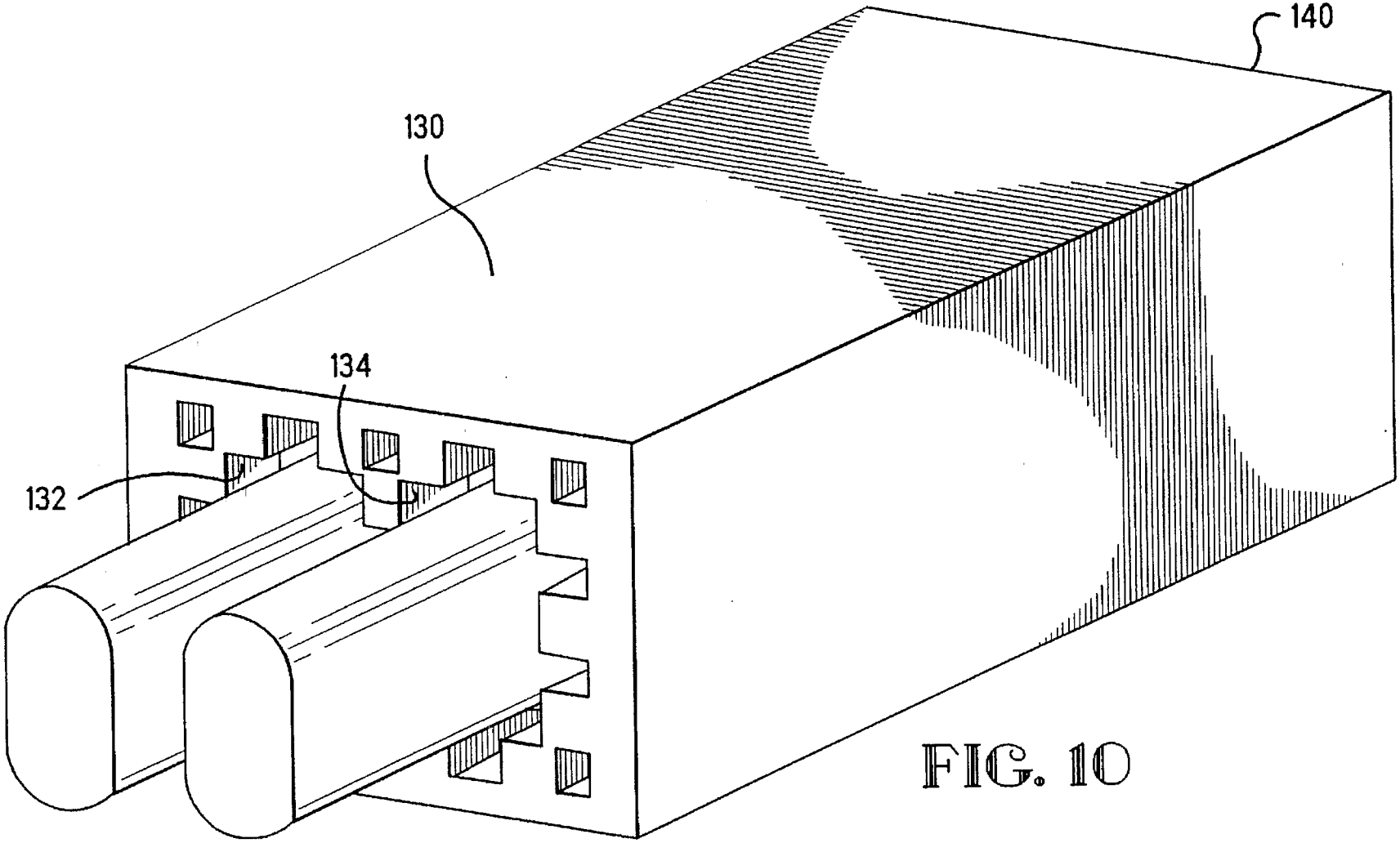
FIG. 10 shows an isometric view of the assembled connector.

With respect now to FIG. 10 an outer housing module is shown at 130 including channels 132 and 134 which are profiled for receiving side byside shielded modules. The housing 130 includes an opening intermediate the openings 132 and 134 for receiving the grounding spring clip therethrough which can be seated in a permanent position. Thus the shielded connector members 88 can be insertable and removable into and out of the channels 132, 134. In this manner, the outer housing 130 together with the installed grounding spring clip 90 can be shipped to the customer while the housing 4, cover 8 and terminals 6 can be assembled in a configuration shown in FIG. 3, and the end user can assemble the cable 62 to the connector 2, later assemble the ground shield 70 and install the shielded subassemblies 88 within the housing 130 into contact with the intermediate spring grounding clip 90. While not specifically shown, the housing 130 would include a front face 140 having apertures in alignment with the openings 40 such that the mating pins can be received within the connector housing 130 and into contact with the contact portions 22, 24, (FIG. 1).

Figure 11:
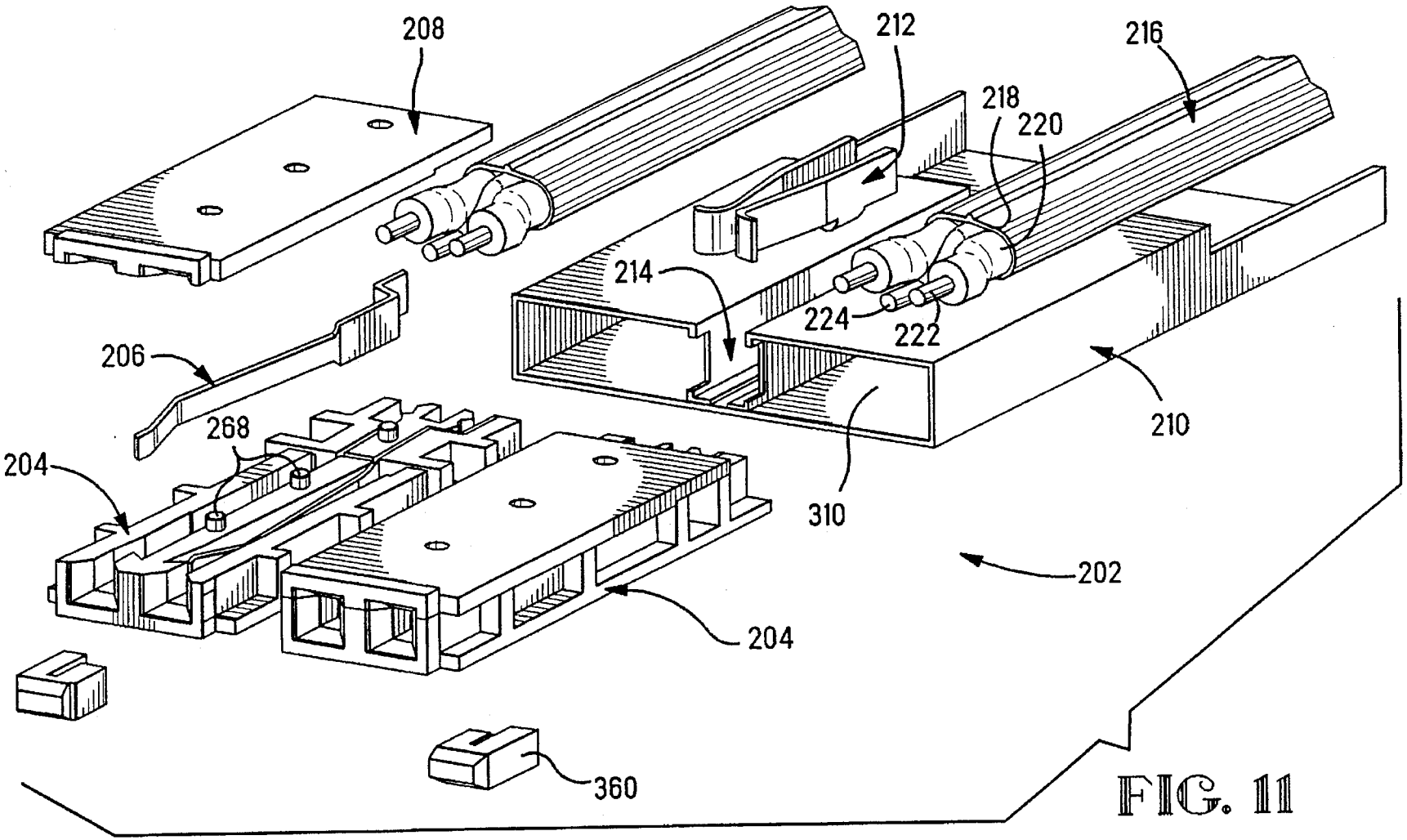
FIG. 11 shows an isometric view of a second embodiment of twinaxial cable connector.

With reference now to FIG. 11, a second embodiment of the invention will be described. A shielded connector is shown generally at 202 comprising an inner housing part 204 having terminals 206 positioned therein and having and upper cover part 208 enclosing the terminal and the inner housing 204. An outer shield member is shown generally at 210 having a centrally disposed shield contact 212 positioned within a central recess 214 formed by the outer shield member 210. In the preferred embodiment of the invention, the connector is profiled for terminating a twinax cable shown generally at 216 comprising an outer insulative cover 218, an inner shield at 220, a signal conductor at 222 and a centrally disposed drain wire 224.

With reference now to FIGS. 13 through 15, the preferred embodiment of the inner housing 204 is shown in greater detail as including a front mating face 230, side walls 232 and an end wall 234. A rear wire terminating section is shown at 236 including channels at 238 which open into cavities at 240 which are defined by opposed side walls 242 and 244 and a recessed platform surface at 246. The side walls 244 are defined by a central upstanding platform portion at 250 which has a rear surface 252 which is recessed from the end wall 244. The housing 204 further comprises forward terminal receiving passageways at 255 which include pin receiving openings at 256 which open into the passageways 255 where each passageway 255 includes side wall surfaces 257, 258 and 259, on one side thereof and side surfaces 260 which extend forwardly and terminate within recess portions shown at 262. As shown best in FIG. 14, the housing 204 includes a major top surface shown at 265 and a lower surface shown at 266. Aligning posts 268 extend upwardly from the major surfaces 265 and could be formed in a multitude of ways, for example with two side by side lugs 268 as shown in FIG. 13 or as three in line lugs as shown in FIG. 11.

Figure 17:
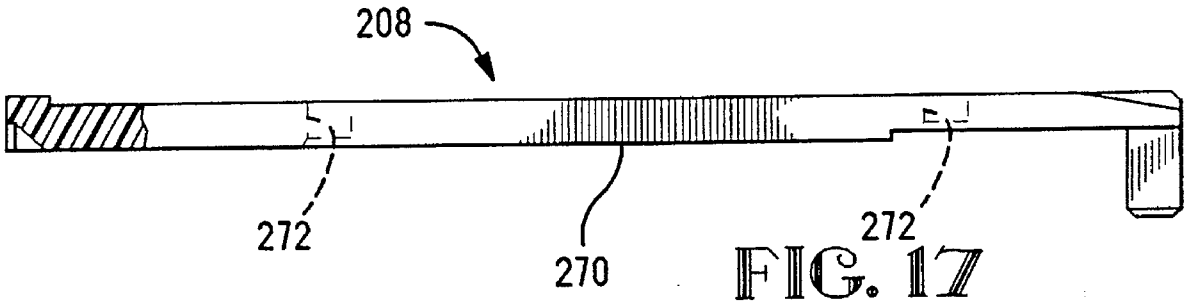
FIG. 17 shows a side plan view of the cover part for use with the housing part of FIG. 16.
Figure 16:
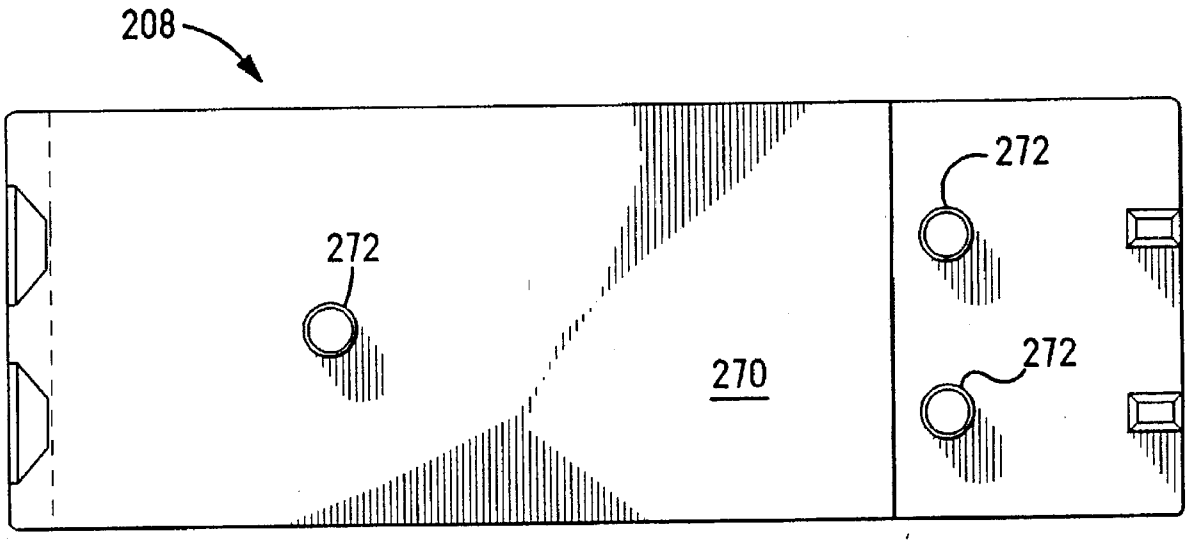
FIG. 16 shows an upper plan view of the cover part for use with the housing part of FIGS. 13–15.
Figure 18:
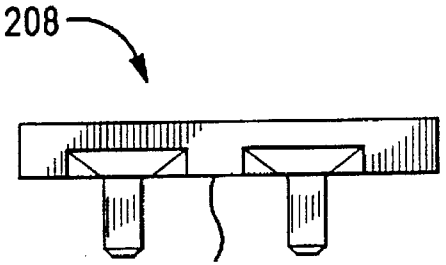
FIG. 18 is an end view of the cover part shown in FIG. 17.

The top cover part 208 is shown best in FIGS. 16 through 18 as including an inner surface at 270 having apertures 272 therein which match the lugs 268 on the housing portion 204.

Figure 19:
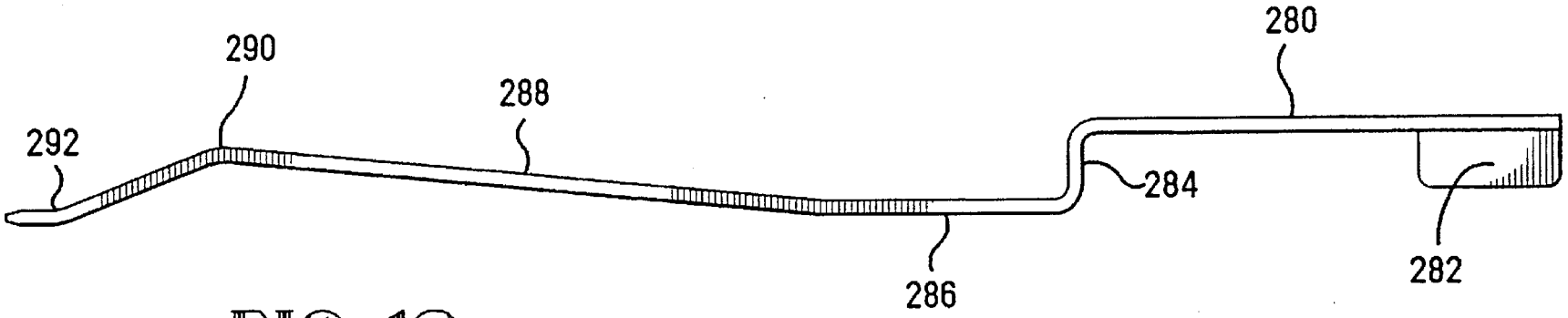
FIG. 19 shows an upper plan view of the signal terminal.
Figure 20:
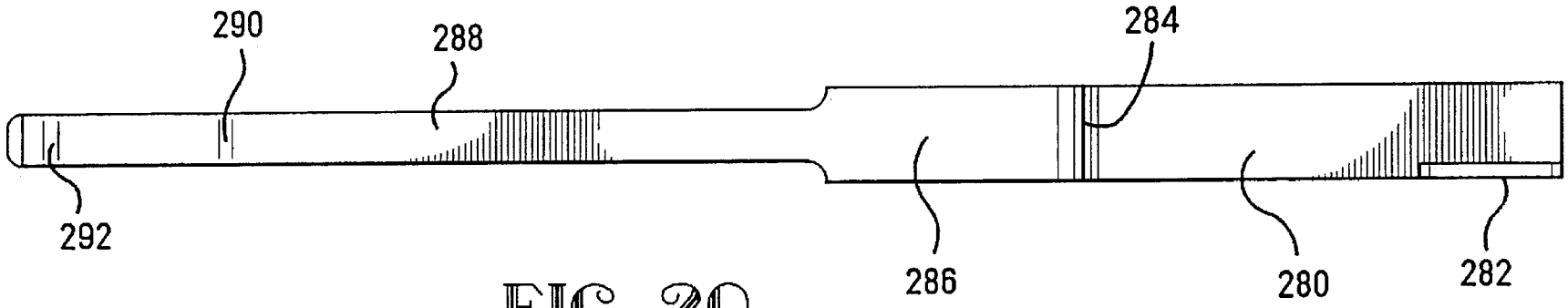
FIG. 20 shows a side plan view of the terminal of FIG. 19.

As best shown in FIGS. 19 and 20, the signal contact 206 is shown as including a beam portion 280 having a transversely situated contact pad 282 thereon, the beam portion 280 extending forwardly through a right angled section 284 and a further beam portion 286 extending forwardly, a cantilever beam portion is shown at 288 which disposes a contact portion at 290 towards a free end portion 292. It should be appreciated that two such contacts 206 are positioned in one single housing 204, although these terminals are not identical, they are mirror images of one another.

Figure 21:
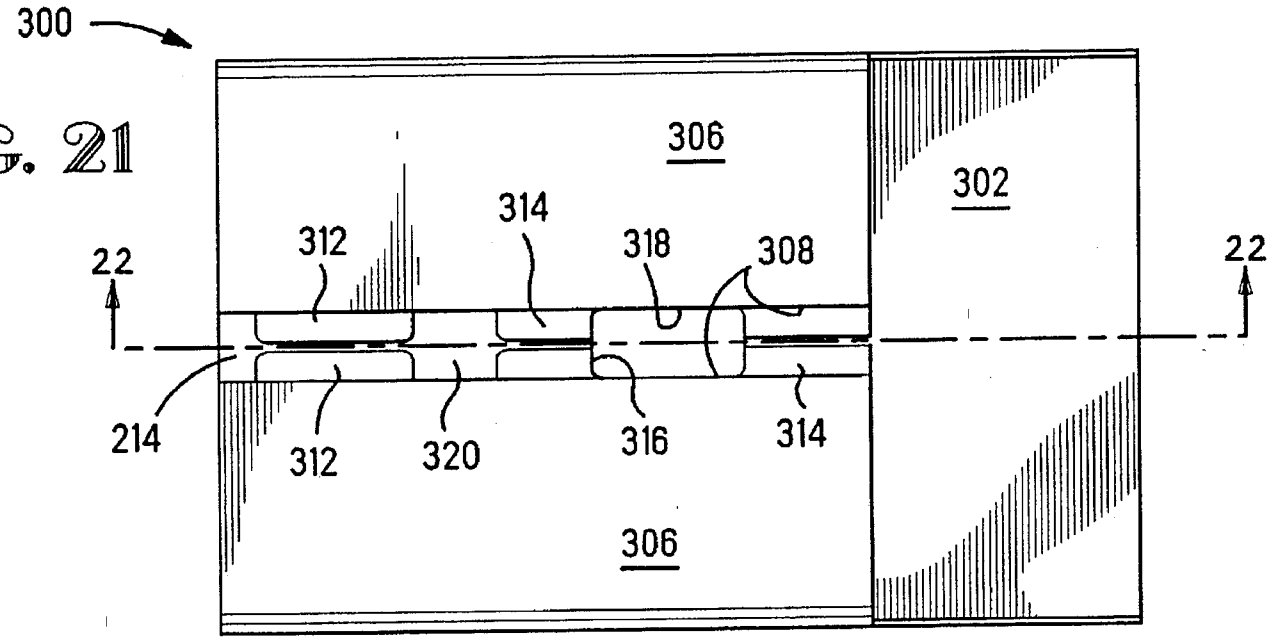
FIG. 21 is a top plan view of the outer shield member.
Figure 22:
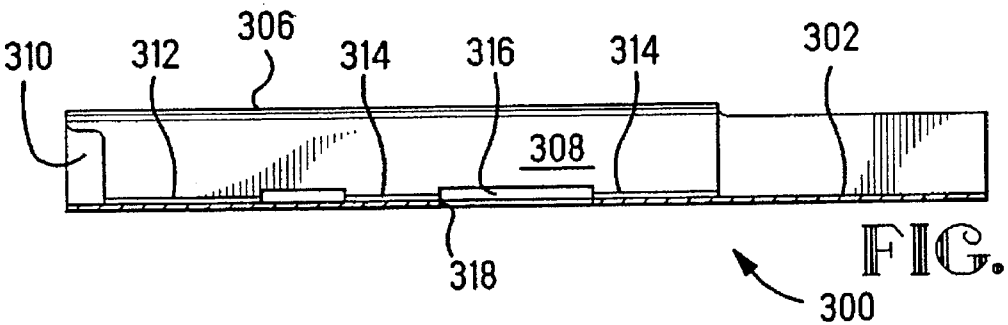
FIG. 22 is a cross sectional view through lines 12—12 of FIG. 21.
Figure 23:
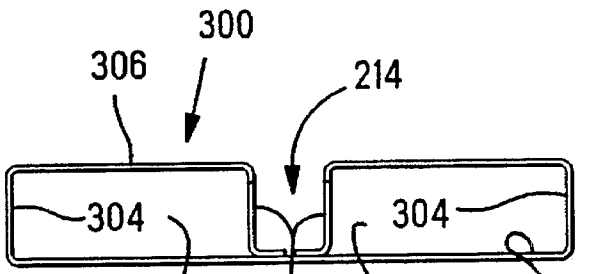
FIG. 23 is an end view of a shield member of FIG. 21.

As best shown now in FIGS. 21 through 23, an outer shield member is shown at 300, which is formed of a unitary piece of metal material, and is formed with a base wall at 302 whereby the base material is formed at right angles thereby forming side walls 304 and further folded over to form top coverparts at 306. The top cover parts are folded downwardly towards the base section having two inner side walls at 308 thereby forming two shielded enclosures at 310. The inner side wall portions 308 include folded over tab portions 312 and 314, where the tab portions 314 are interrupted by an opening 316 which overlies an opening 318 in the base portion. Intermediate the tab members 312 and 314, a nest 320 is formed for a ground contact as will be described herein.

Figure 24:
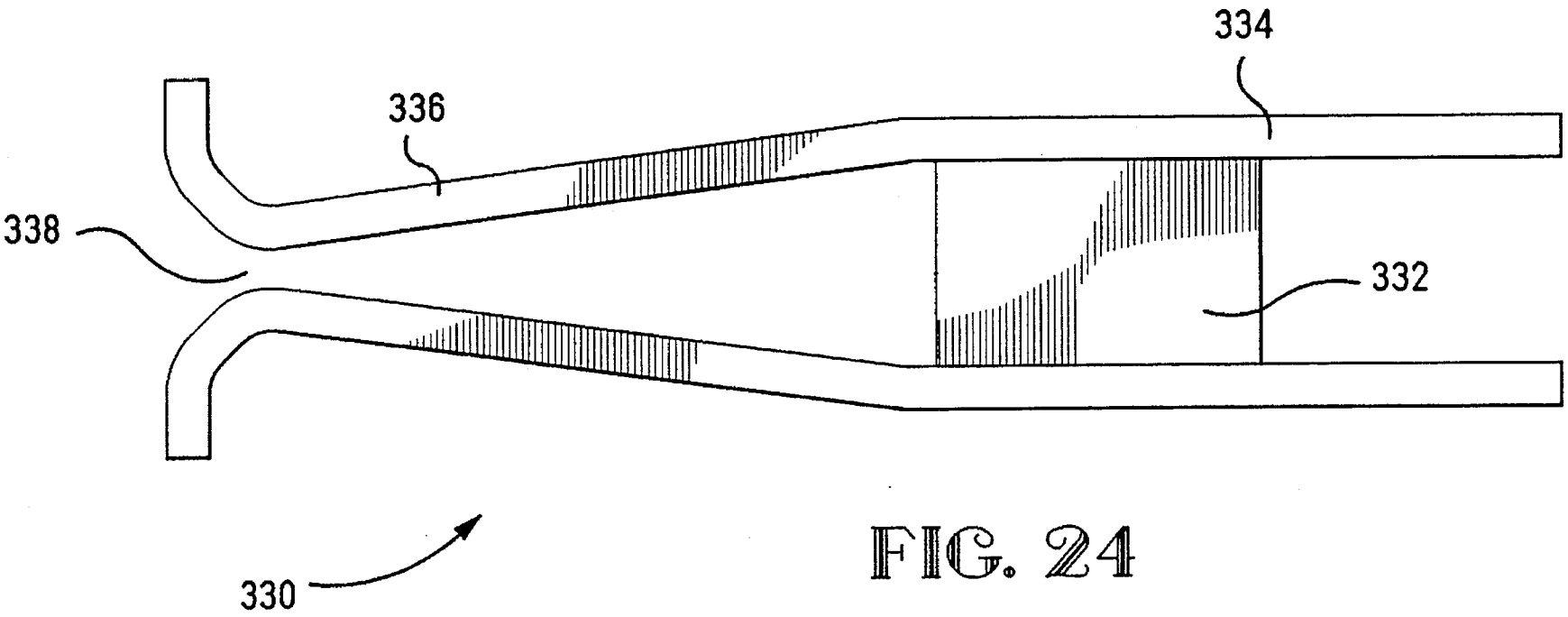
FIG. 24 is an upper plan view of the shield contact for use with the shield member.

With respect now to FIG. 24, a ground contact is shown at 330 including a lower base portion 332 having folded up side edges 334 which form cantilever beam sections 336 forwardly to form a contact at 338.

Figure 25:
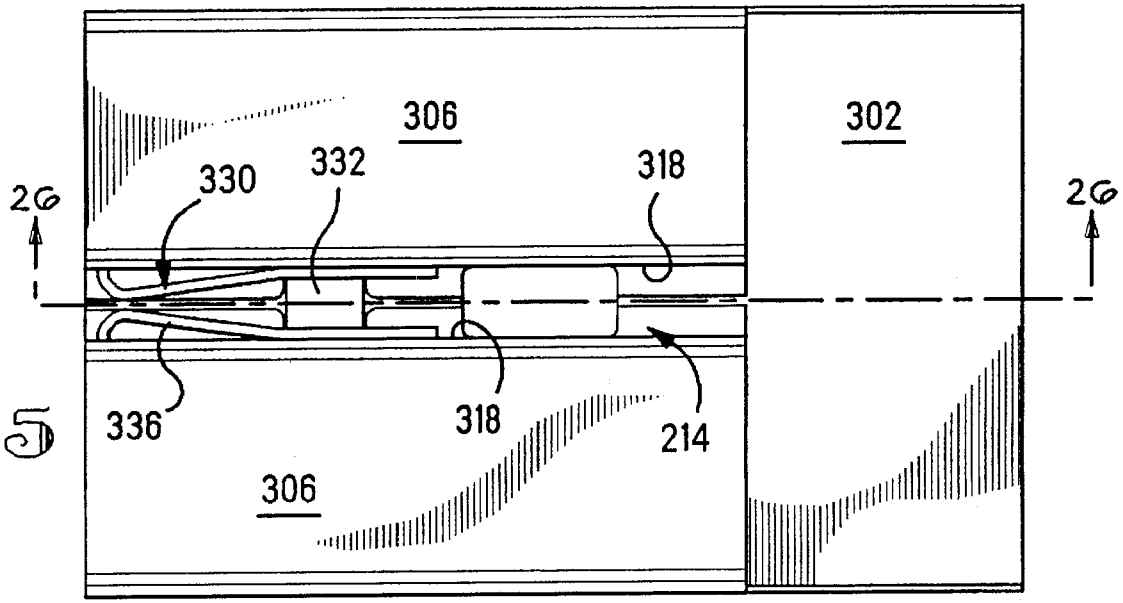
FIG. 25 is an upper plan view of the shield member with the terminal positioned centrally of the shield member.
Figure 26:
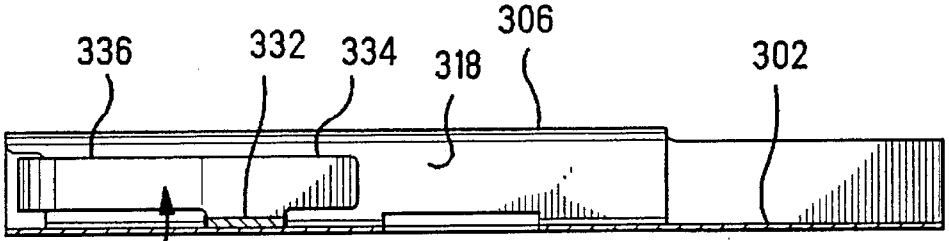
FIG. 26 is a cross sectional view through lines 16—16 of FIG. 25.
Figure 27:
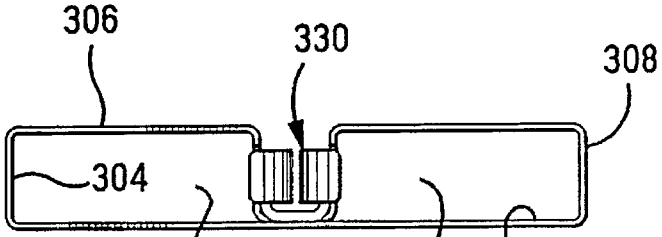
FIG. 27 is an end view of the left hand side of the assembly of FIG. 25.

With respect now to FIGS. 25 through 27, the shield contact 330 is shown disposed within the shield member 210 within the cavity 214 defined between adjacent inner side walls 318 of the shield. As shown best in FIG. 26, the lower base section 332 is located in the nest section 320, positioned between the tab sections 312 and 314, and preferably the base section 332 is fastened to the base wall 302 of the shield member 210 by a welding, such as spot welding. As shown best in FIG. 27 as positioned, the ground contact 330 has the contact section 338 disposed outwardly of the shield member whereas two shielding enclosures 310 flank either side of the terminal 330.

With respect now to FIGS. 11, 15 and 19, the terminals 206 are positioned within the housing 204 such that the beam portion 286 is positioned in the channels 238, which disposes the beam portion 280 adjacent to the outer walls 242, thereby disposing the contact pad 282 on the platform surface 246. This also disposes the beam portion 286 forwardly from the channels 238 such that the cantilever beam 288 extends obliquely across the passageway 255 such that the contact surface 290 is positioned adjacent to side wall portions 257 and 258, while the free end portion 292 is disposed behind the corner at 262. As shown in FIG. 11, the housings 204 can then be closed by placing the cover 208 over the top and the housings 204 can be slidably received in the shielding enclosure 310. It should be noted that the top cover walls 306 of the shield member 300, are shorter than the base wall 302, as best shown in FIG. 21, such that a portion of the base wall 302 is exposed from an upper side of the shield member 300. This positions the housing member within the shielding enclosure to a position shown in FIG. 28, such that the contact pads 282 are accessible from a top portion of the shield member 300.

Figure 12:
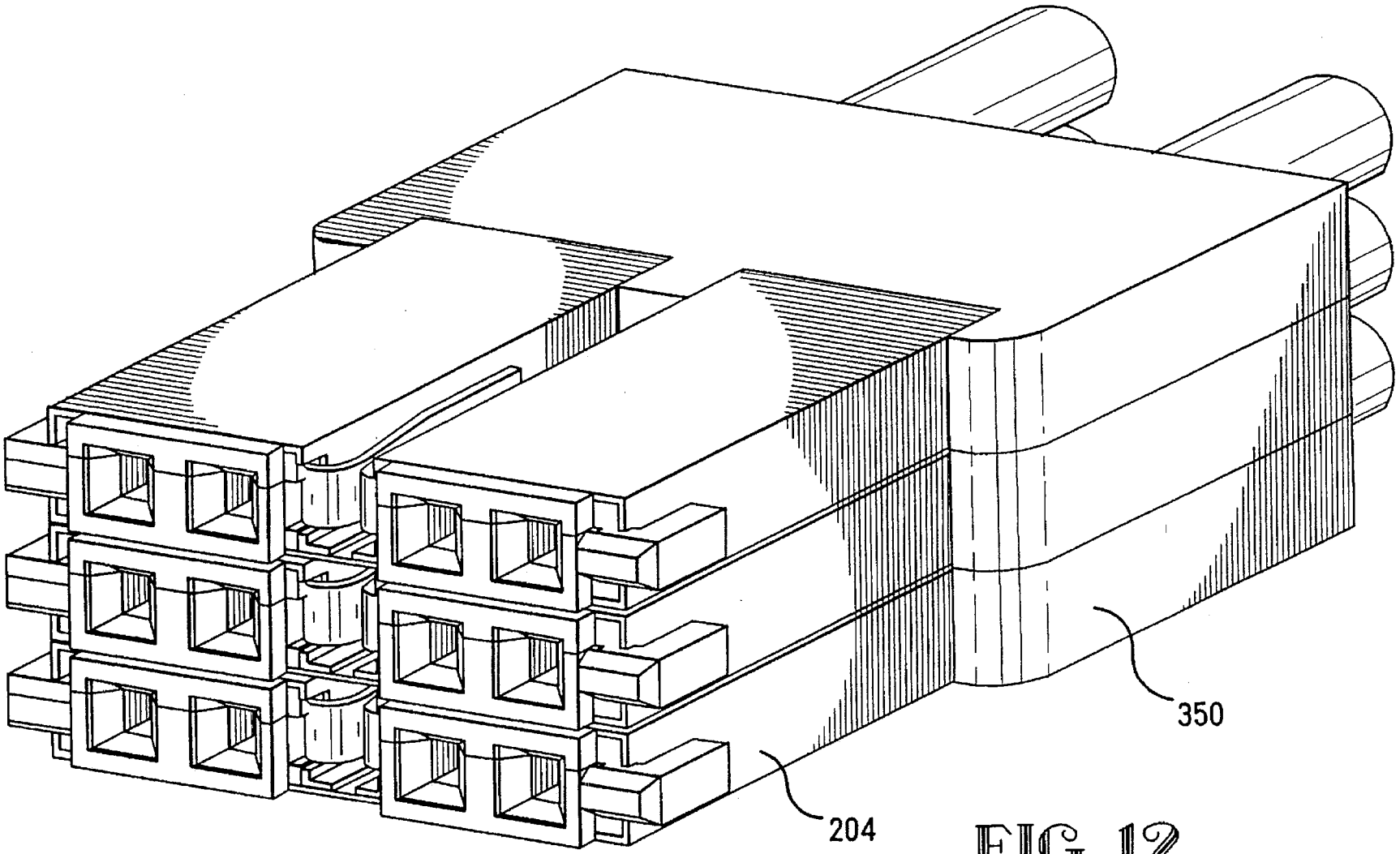
FIG. 12 shows an assembled view of the detail of the cable connector shown in FIG. 11.
Figure 28:
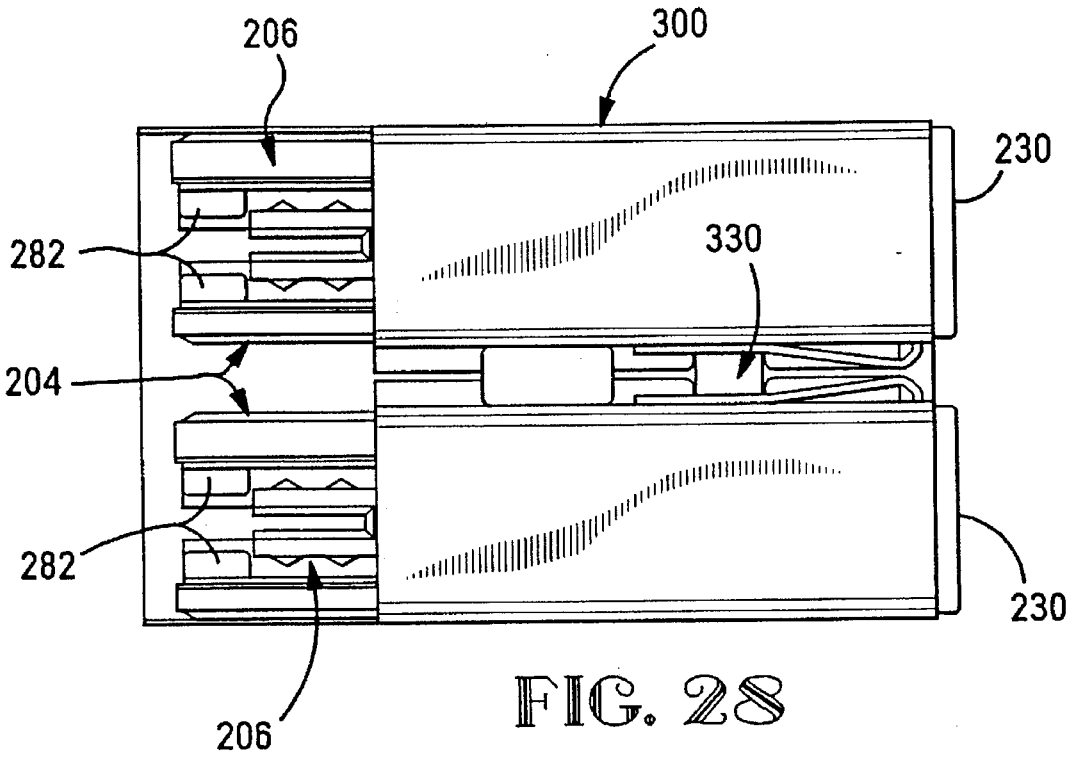
FIG. 28 is an upper plan view of the shield member of FIG. 25 showing the housings positioned within the shield member.
Figure 29:
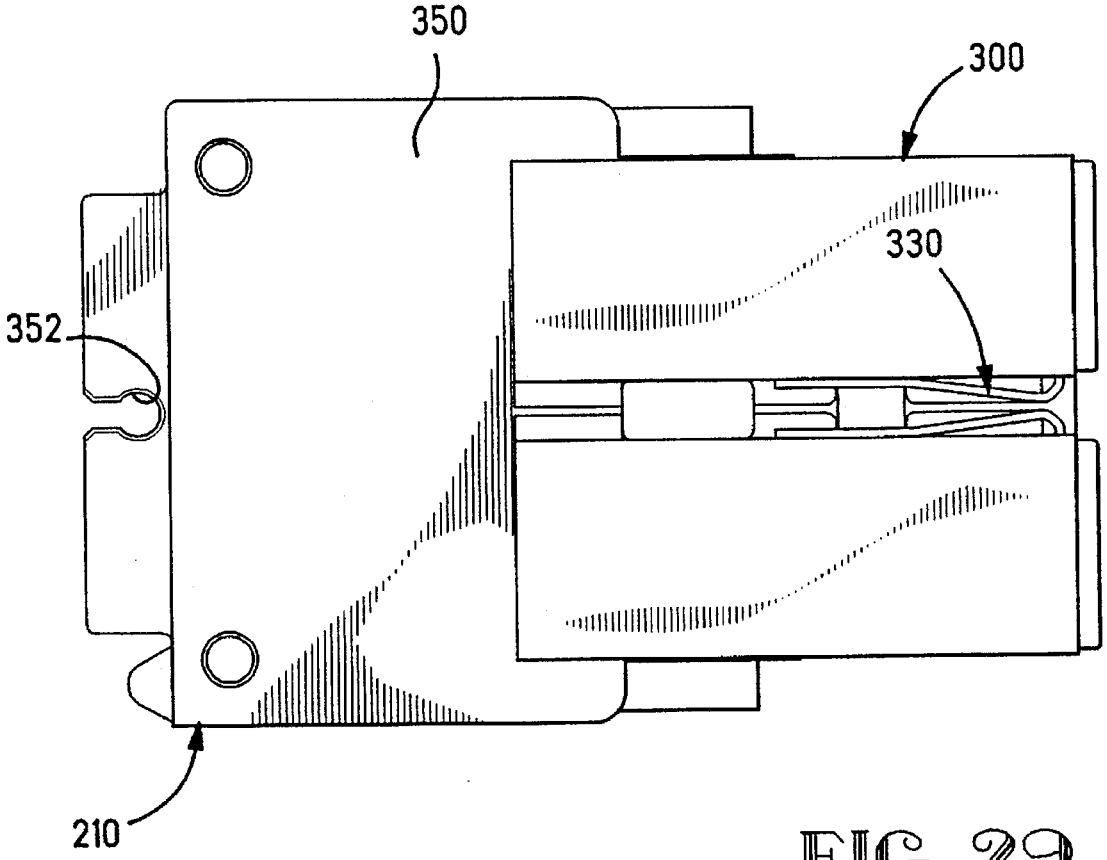
FIG. 29 is an upper plan view of the connector of FIG. 28 showing an overmoulded rear housing part less the twinax cables.
Figure 30:
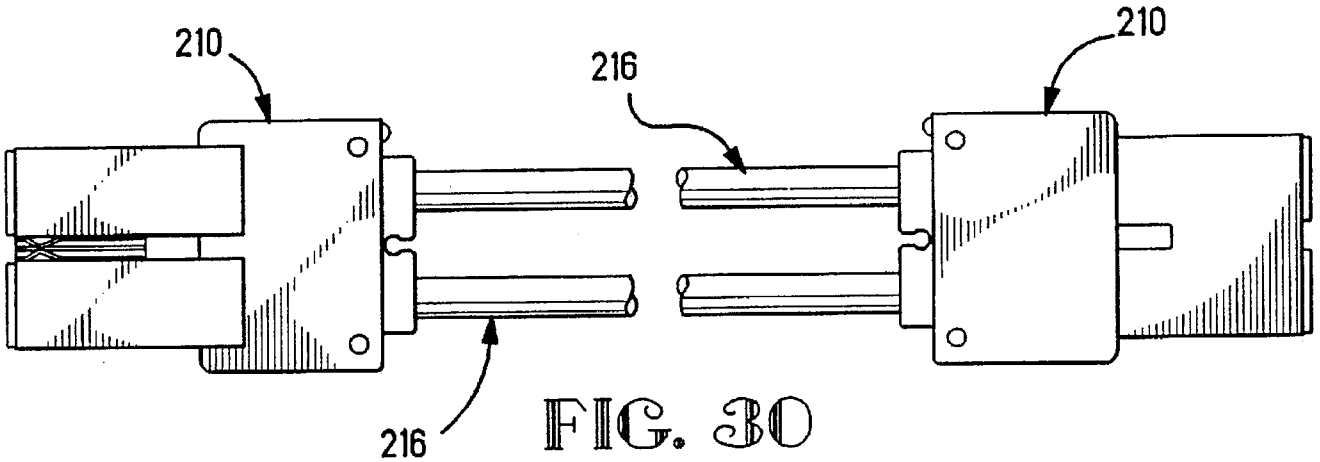
FIG. 30 shows a total cable assembly with the cables inmoulded.
Figure 31:
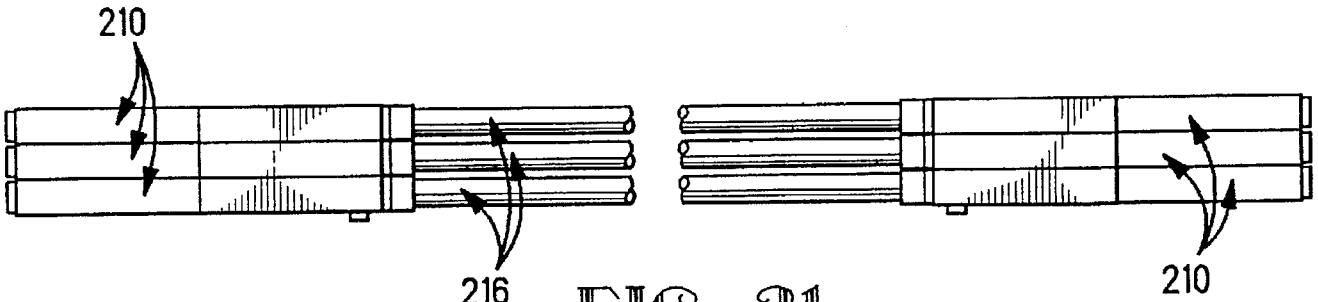
FIG. 31 shows a side plan view of the connector assembly of FIG. 30.
Figure 32:
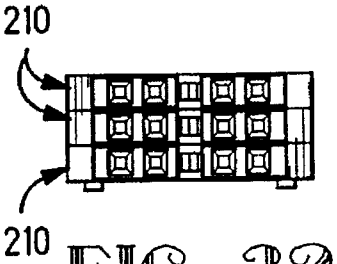
FIG. 32 shows an end view of the assembly shown in FIG. 31.

The connector is assembled by positioning the twinaxial cable 216, as prepared as shown in FIG. 11, over the connector as assembled in FIG. 28, with the signal contacts 222 positioned over adjacent contact pads 282, and with the drain wire 224 disposed between the contact pads. All three conductors can then be welded to their associated conductive part which electrically connects the twinax cable 216 to the connector assembly. As shown in FIG. 29, an overmoulding web shown best at 350 can be positioned over the inner housing portions, and in particular over the rear section of the housing 204, to enclose the twinax cables 216 therein. As shown in FIG. 29, the outer moulded web 350 includes a keyed opening at 352, which allows several housings to be placed one above the other as shown in FIG. 12, with a pin or post positioned through aligned keyed openings 352 to retain them together. As shown in FIG. 11, key members 360 can be attached to the housing members 204, which allow polarized connection to a mating connector.

I claim:

1. A high density shielded electrical connector for terminating a shielded cable comprising at least two insulating housings, each insulating housing having signal contacts and being enclosed by a shielding member, a grounding spring clip disposed between said shielding members and being in contact with a wall of said shielding members and being retained therewith, grounding spring clip defines a mating contact open in the same direction as said signal contacts.

2. The connector of claim 1, wherein each of said shielding members are crimpable to shielded cable to common the shielding members with an outer shield of the respective cable.

3. The connector of claim 1, wherein said grounding spring clip is V-shaped in cross-section, including a constricted forward section at the open end forming a contact portion for a pin, and an intermediate portion having outward projections forming contact portions for contacting adjacent shield members.

4. The connector of claim 1, wherein the connector includes at least two of said shielding members and said grounding spring clip is disposed between said shielding members.

5. The connector of claim 1, wherein said shielding members are formed from one piece where a U-shaped nest with the two walls being spanned by a bottom wall is established and said grounding spring clip is disposed between said two walls.

6. The connector of claim 1, wherein said housing and shielding members are positioned in a housing having receiving openings therein profiled to receive said shielding members, and said grounding spring clip is positioned in said housing intermediate said shielding members.

7. The connector of claim 3, wherein said groundling spring clip is insertable into said housing, through a rear face thereof, and lockable therein, whereby the grounding spring clip is retained with the shielding members.

8. The connector of claim 6, wherein said shielded housings are insertable and removable into the housing, while said grounding spring clip remains locked in the housing.

9. An electrically shielded connector having an inner housing having signal contacts positioned therein, and a shield member surrounding said inner housing, said connector being characterized in that said shielded connector includes a one piece shield member folded from its ends over towards its center, thereby forming two shielded enclosures, and centrally spaced apart section which carries a shielding contact for contact with a ground pin.

10. The connector of claim 9, characterized in that the shield is folded so as to form two rectangular shield enclosures.

11. The connector of claim 9, characterized in that said shielded enclosures receive therein, rectangular shaped inner housing, carrying said signal contact.

12. The connector of claim 9, characterized in that the shielding contact is a discrete member positioned between inner two shielded enclosures.

13. The connector of claim 9, characterized in that the shielding contact is welded to the outer shield.

14. The-connector of claim 9, characterized in that said outer shield comprises a lower base wall, two outer side walls, two top cover parts which project inwardly towards a longitudinal center line of the outer shield, and two spaced apart inner walls projecting downwardly to the base wall.

15. A high frequency shielded cable connector for interconnecting the conductors of a shielded cable to pins of a pin field, comprising:

four signal contacts for terminating separate signal conductors of the shielded cable and engaging separate pins of the pin field, where each signal contact includes a resilient contact spring arm for electrically engaging the corresponding pin and a conductor terminating portion opposite the contact spring arm for electrically engaging the respective conductor;

a ground contact having a spring arm extending from a base for engaging the respective pin member of the mating component;

an insulating body including an inner housing having a linear array of four signal contact receiving passageways extending thereacross and Said channels spaced in two pairs of two channels, the passageway including a front portion extending into a rear terminating portion of the body, where a corresponding one of the signal contacts is received within the passageway such that the spring arm is in the forward section and the conductor terminating portion is disposed in the rear terminating portion, where the ground contact is disposed between the two sets of signal contacts and orientated such that the spring arm is correspondingly disposed with the contact spring arm of the signal contacts;

and a shield encasing the body such that the signal contacts therein are surrounded by the shield.

16. The connector of claim 15, wherein the shield includes a shield engaging portion for electrically commoning a shield of the shielded cable with the shield of the connector and the ground contact.

17. The connector of claim 15, wherein the connector includes a drain wire termination point enabling a drain wire of the shielded cable to be commoned with the shield and the ground contact.

18. The connector of claim 15, wherein the signal contact includes a single contact arm.

19. The connector of claim 15, wherein the receiving passageways define a pair of walls between which the ground contact is positioned.

20. The connector of claim 15, wherein the ground contact is disposed within the linear array of the signal contacts such that each of the contacts are spaced an equal distance from each other.

21. The connector of claim 20, wherein the contact spring arms of the signal contacts and the cantilever arm of the ground contact are displaceable along the array.

22. The connector of claim 21, wherein the body includes an inner housing and a cover, the inner housing including the passageways therein.

23. The connector of claim 22, wherein the body includes two halfs, each half having two of the passageways therein.

24. The connector of claim 20, wherein the shield member is of tubular construction having an open first end corresponding to the open end of the front portion of the body and a open second end corresponding to the rear terminating portion.

25. The connector of claim 24, wherein the shield is of one piece construction.

26. The connector of claim 24, wherein the body portion extends from the first open end of the shielding thereacross and short of the second open end such that a portion of the shielding is exposed towards the second end.

27. The connector of claim 24, wherein the body portion includes an opening between the two sets of signal passageways exposing a surface of the shield contactable by the ground contact.

28. The connector of claim 24, wherein the inner housing and the cover each include a portion extending out of the first open end, where the portions include tapered lead-in surfaces for the front portion of the passageway for guiding the corresponding pin into engagement with the contact contained therein.

29. The connector of claim 24, wherein the ground contact is electrically connected to the shield along a surface that overlies at least one side of all of the signal contacts.

30. The connector of claim 29, wherein the ground contact is resistance welded to the shield.

31. The connector of claim 15, wherein the connector is stackable with similarly formed connectors to form a column of linear arrays.

32. The connector of claim 31, wherein the spacing of the adjacent linear arrays is equal to the spacing between adjacent contacts within a particular linear array.

33. The connector of claim 32, wherein the individual connectors include a keying opening and a keying post such that adjacent connectors may be aligned.

34. The connector of claim 32, wherein the individual connectors include keys for polarization to a mating connector.

35. A cable connector for interconnecting conductors of a shielded cable to pins of a pin field, said connector comprising:

four signal contacts for terminating separate signal conductors of the shielded cable and engaging separate pins of the pin field, each signal contact including a resilient contact spring arm for engaging the pin, where each signal contact is positioned with a signal contact receiving passageway formed in an insulating material;

a ground contact for engaging a corresponding pin of the pin field, said ground contact having a resilient spring arm for engaging the pin, where said ground contact is positioned between two of the signal contacts; and a conductive shield member surrounding said signal contacts and the ground contact being commoned therewith, said signal and ground contacts being arranged in a linear array.

36. The cable connector of claim 35, where the ground contact includes an opposing pair of resilient contact arms.

37. The cable connector of claim 35, where keying members can be attached to the connector to allow polarized connection to a mating connector wherein the pin field is disposed.

38. The cable connector of claim 35, where the conductive shield member is formed to have opposing open ends for receiving the pins and conductors therein respectively.

39. The cable connector of claim 35, where the ground contact separates the signal contacts into two pairs.

40. The cable connector of claim 39, where the resilient contact arms of the signal contacts and the ground contact are deflectable along the linear array.

41. The cable connector of claim 35, where the conductive shield member fully encloses the signal contacts.

42. The cable connector of claim 41, wherein the conductive shield member is formed from a single piece.

43. A cable connector for interconnecting conductors of a shielded cable to pins of a pin field, said connector comprising;

four signal contacts for terminating separate signal conductors of the shielded cable and for engaging separate pins of the pin field, each signal contact including a resilient contact spring arm for engaging said pin, where each signal contact is positioned in a corresponding signal contact receiving passageway formed of insulating material and having a forward portion with an open end for receiving the pin therethrough and the resilient spring arm being disposed in said forward portion;

a ground contact for engaging a corresponding pin of said pin field and having a resilient contact spring arm for engaging the pin where the ground contact and the signal contacts are arranged in a linear array with said ground contact being positioned between two of the signal contacts where both ground and signal contacts are similarly aligned for plugability to the pins; and a conductive shield surrounding the signal contacts and having open ends so that the pins are receivable by the connector to engage the spring arms and the cable conductors are able to reach the signal contacts therein, where the ground contact is electrically commoned to said shield along a surface thereof that corresponds to an inner surface surrounding the signal contacts.

44. A cable connector for interconnecting conductors of a shielded cable having conductors and a drain wire surrounded by an inner shield to pins of a pin field, the conductor comprising;

four signal contacts, each contact having a resilient spring contact arm for engaging corresponding pins and a conductor terminating section for terminating the respective conductor of the cable, each signal contact is disposed within a corresponding channel defined by side walls formed of insulative material where the channel includes a terminal receiving portion wherein the resilient arm is disposed and a pin receiving opening at an end thereof for receiving the respective pin into the channel for engagement with said resilient spring contact arm, said four signal contacts being arranged in a linear array to define a linear row of signal contacts;

a ground contact having a resilient spring contact arm for engaging a corresponding pin of the pin field where said ground contact is disposed within the linear row of signal contacts and located between two of the signal contacts said ground contact including a base portion from which the spring arm extends; and a conductive shield member surrounding the signal contacts and spanning at least one side of the ground contact with a surface corresponding to the surface of the shield surrounding the signal contacts, the base of the ground contact being electrically commoned to the shield.

45. The electrical connector of claim 44, where the shield extends rearward beyond the insulative material having the channels therein.

46. The electrical connector of claim 44, where the resilient spring arms of the signal contacts and the ground contact are deflectable in response to engaging a corresponding pin along the direction of the linear array.

47. The electrical connector of claim 44, wherein the drain wire of the cable are electrically connected to the shield.

48. The electrical connector of claim 44, where the ground contact includes a plurality of spring arms.

49. The electrical connector of claim 48, where two of the plurality are arranged in an opposing manner.

50. The electrical connector of claim 44, whereupon a keying member for orienting the connector with respect to a mating connector may be disposed on the connector.

51. The electrical connector of claim 50, wherein the keying members are disposed outward at the ends of the linear array.

52. The electrical connector of claim 51, wherein the keying member is formed separately of the connector.

* * * * *